US006206595B1

(12) United States Patent
Keda

(10) Patent No.: US 6,206,595 B1
(45) Date of Patent: Mar. 27, 2001

(54) WRITING UTENSIL

(75) Inventor: Tadashi Keda, Kawagoo (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/327,513

(22) Filed: Jun. 8, 1999

(30) Foreign Application Priority Data

Aug. 28, 1998 (JP) ..... 10-243861

(51) Int. Cl.[7] ..... A46B 5/02
(52) U.S. Cl. ..... 401/6; 401/195
(58) Field of Search ..... 401/6, 7, 195, 401/52, 208

(56) References Cited

U.S. PATENT DOCUMENTS 141,287 * 7/1873 Orndorff ..... 401/6
798,749 * 9/1905 Rose ..... 401/6
3,113,558 * 12/1963 Marraffino ..... 401/6
5,354,140 * 10/1994 Diakoulas ..... 401/6
6,027,151 * 2/2000 McNab et al. ..... 401/6
6,056,462 * 5/2000 Fukai et al. ..... 401/6

FOREIGN PATENT DOCUMENTS

1375484 * 2/1988 (SD) ..... 401/6
WO88/04995 * 7/1988 (WO) ..... 401/6

* cited by examiner

*Primary Examiner*—David J. Walczak
(74) *Attorney, Agent, or Firm*—McGinn & Gibb, PLLC

(57) ABSTRACT

A writing utensil includes a writing stem having a first surface section of a soft elastic material, and a second surface section of a relatively hard material. An interdigital support section formed of a soft elastic material supports the interdigital portion between a thumb and a forefinger of a user gripping the writing stem.

60 Claims, 9 Drawing Sheets

WRITING UTENSIL

BACKGROUND OF THE INVENTION

1. Field of the Invention

The present invention relates to a writing utensil, and more particularly to a writing utensil having a writing stem whose surface includes a section made of a soft elastic material and another section made of a hard material.

2. Description of the Related Art

In a conventional writing utensil, its writing stem includes a fingertip support section which comes into contact with a fingertip of the user who grips the writing stem. The fingertip support section is made of a soft elastic material to achieve a non-slip effect.

Such a soft elastic material constitutes a barrel section separate from another section made of a hard material in the writing stem. The writing utensil is manufactured by fitting the barrel section in an annular groove made of a hard material, or by integrally molding the writing stem, which consists of a section made of a soft elastic material and another section made of a hard material, through a dichromatic molding technique, as described in Japanese Utility Model Publication No. 2537274.

When using the writing utensil, the user usually grips the writing stem with three fingers. That is, the thumb, the forefinger, and the middle finger grip the writing stem. However, in addition to those fingers, the interdigital portion between the thumb and the forefinger sustains the writing stem. If the interdigital portion contacts a hard section in the writing stem, the user may feel finger fatigue from continuous writing. Also, if the interdigital portion slips off the writing stem, the user's grip may become unstable.

SUMMARY OF THE INVENTION

In view of the foregoing and other problems, disadvantages, and drawbacks of the conventional writing utensil, the invention has been devised, and it is an object of the invention, to provide a writing utensil which makes the user's grip feel more stable when gripping a writing stem of the writing utensil and which makes the user feel less fatigue after a long period of writing.

To attain the above and other objects, the present invention provides a writing utensil having a writing stem whose surface includes a section made of a soft elastic material and another section made of a hard material. The writing utensil includes at least an interdigital support section made of a soft elastic material which comes into contact with the interdigital portion between the user's thumb and forefinger gripping the writing stem.

Since the interdigital portion between the thumb and the forefinger comes into contact with the soft elastic material, the user's grip feels more stable when gripping the writing stem. That is, since the interdigital portion between the thumb and the forefinger is supported with the soft elastic material, the writing stem feels soft to the user's hand, and the elastic material achieves a non-slip effect, so that the user can grip the writing stem in a very stable position with no shaky movement of the writing stem's rear end. An increased variety of designs can be applicable to the writing utensil according to the present invention.

Optionally, the writing utensil can further include a fingertip support section made of a soft elastic material which contacts a user's fingertip gripping the writing stem. Since the fingertip comes into contact with the soft elastic material, that elastic material achieves a non-slip effect and the user perceives increased stability when gripping the writing stem. Also optionally, the interdigital support section and the fingertip support section can be connected to each other by a soft elastic material. During the manufacturing process, the interdigital support section and the fingertip support section can be formed of a soft elastic material at a same time.

A smooth surface of the soft elastic material can achieve a sufficient non-slip effect. However, it should be also appreciated that the interdigital support section may have a jagged (e.g., serrated, irregular, nonuniform, etc.) surface. Alternatively, the surface of the interdigital support section may be recessed in a smooth curve. The interdigital support section can achieve an improved non-slip effect through such a jagged surface and the section can come into contact with the user's interdigital portion more fittingly through such a recessed surface.

The interdigital support section can be located at any position where the section may come into contact with the user's interdigital portion between the thumb and the forefinger. However, the writing utensil may have a clip which extends in a longitudinal direction parallel to the writing stem, and the interdigital support section may be located substantially in a position opposed to the clip on the circumference of the writing stem. If such a clip is provided, the user would usually grip the writing stem such that the clip is unobtrusive to the user. Therefore, if the interdigital support section is located substantially in a position opposed to the clip, the user's interdigital portion contacts the soft elastic material more surely.

Also, the present invention is applicable to a writing utensil which has a control section for feeding writing media located at the rear end of the writing stem. However, such a control section for feeding writing media may be located in the middle of the writing stem, and the interdigital support section may be located substantially in a position opposed to the control section on the circumference of the writing stem. If such a control section is provided, the user usually grips the writing stem such that the control section does not impede the user, but instead makes the utensil easier to operate. Therefore, if the interdigital support section is located substantially in a position opposed to the control section, then the user's interdigital portion can come into contact with the soft elastic material more surely and reliably.

Moreover, those sections made of the soft elastic material can be separate from those made of a hard material and can be bonded to each other by fitting or attaching. However, the soft elastic material and the hard material may constitute the surface of the writing stem through dichromatic molding.

The present disclosure relates to subject matter contained in Japanese Patent Application No. 10-243861, filed Aug. 28, 1998, which is expressly incorporated herein by reference in its entirety.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF PREFERRED EMBODIMENTS OF THE INVENTION

Figure 1:
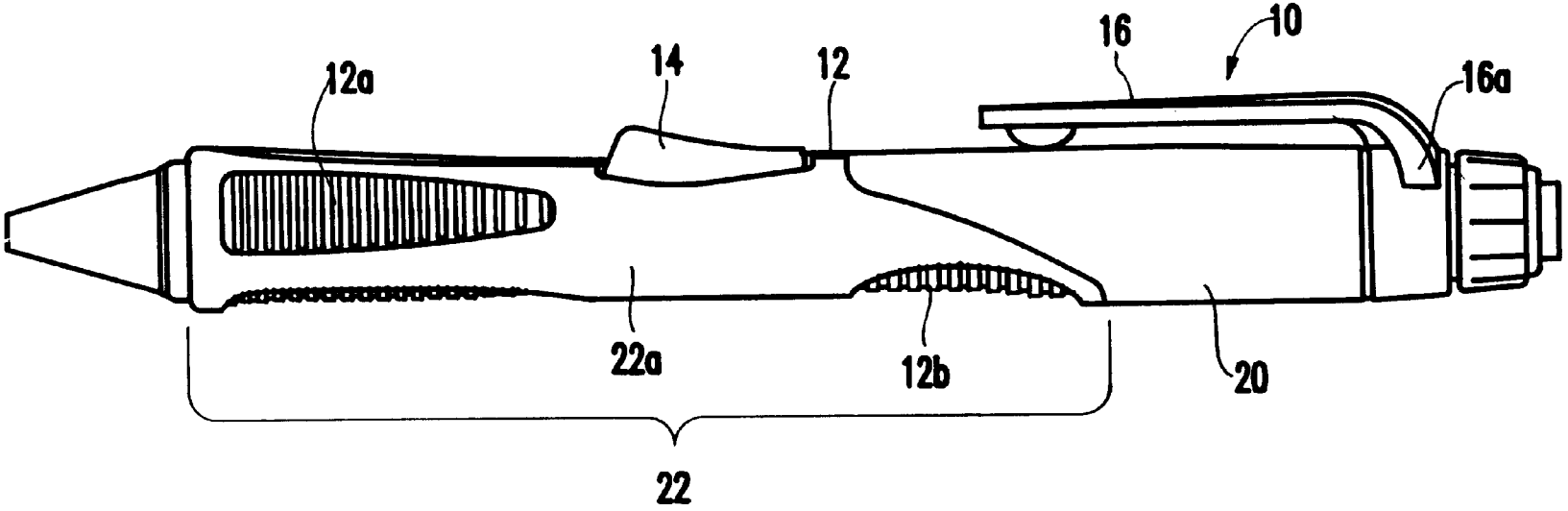
FIG. 1 shows a side view of a first embodiment of the writing utensil according to the present invention.

Referring now to the drawings, and more particularly to FIGS. 1–11, there are shown preferred embodiments of the method and structures according to the present invention.

Preferred embodiments of the present invention will be described below with reference to the accompanying drawings.

First Embodiment

Figure 2:
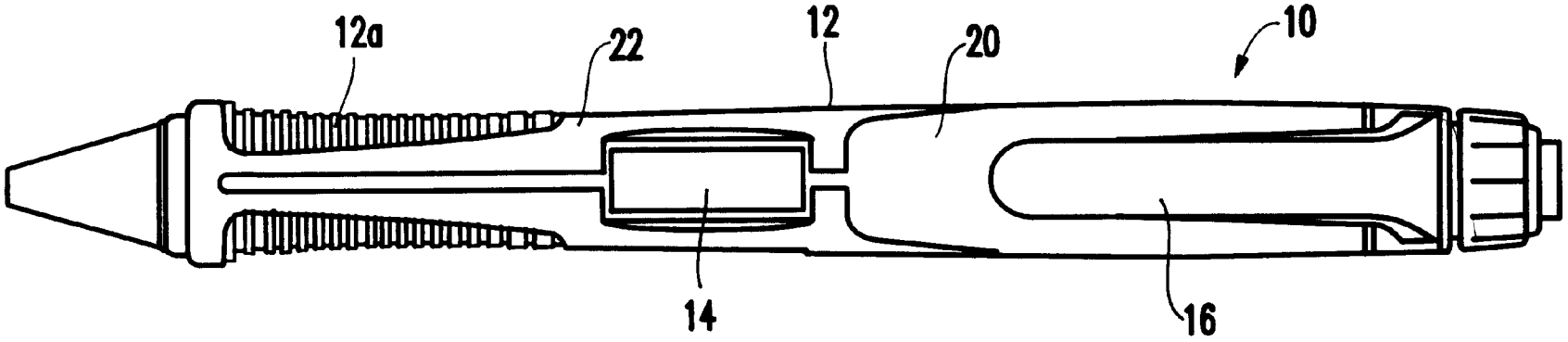
FIG. 2 shows a front view of the first embodiment.
Figure 3:
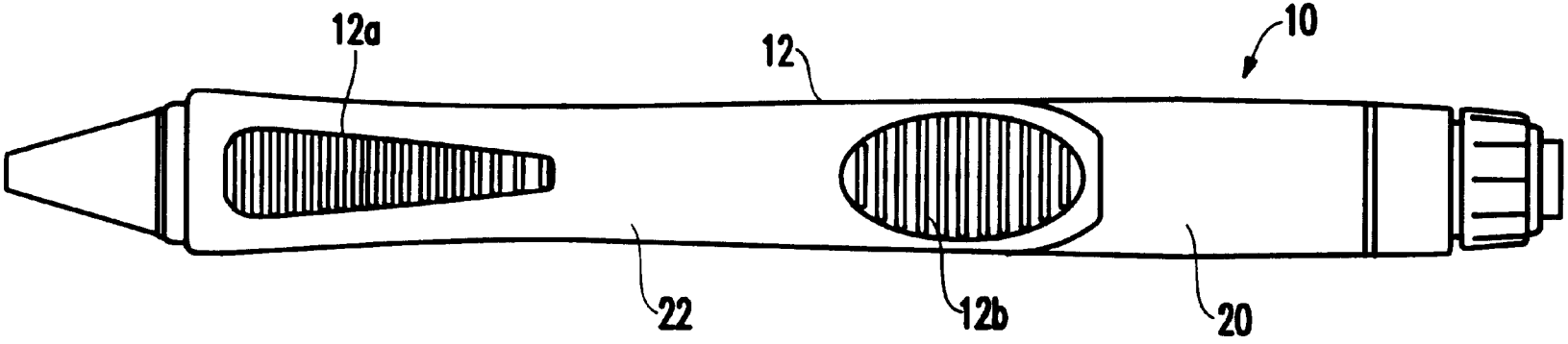
FIG. 3 shows a rear view of the first embodiment.

Referring to FIGS. 1–3, a first embodiment of the present invention will be described below.

As shown in these figures, an exemplary writing utensil (instrument) 10 is a side knock-type propelling pencil (e.g., mechanical pencil), which contains within its writing stem 12 a conventional writing medium (e.g., lead), a feeding mechanism for feeding a predetermined amount of lead, and also includes a control section 14 projecting from the middle of the writing stem 12 and located in an axial direction. Lead can be fed by depressing control section 14. It is noted that instead of lead, other writing media could be used.

The writing stem 12 further includes a base 16*a* for a clip 16 at the rear end. The clip 16 extends from the base 16*a* in a longitudinal direction parallel to the writing stem 12.

The writing stem 12 includes a hard section 20 whose surface is made of a hard material such as ABS resin and acrylic resin and a soft section 22 whose surface is made of a soft elastic material such as silicone rubber, olefin elastomer, vinyl chloride elastomer, styrene elastomer, and/or another thermoplastic elastomer. The hard section 20 and the soft section 22 can be integrally molded through dichromatic molding or another technique.

The soft section 22 extends from the forebarrel portion to the middle portion of the writing stem 12 except for the control section 14. More particularly, the soft section 22 includes a fingertip support section 12*a* which usually contacts tips of the user's thumb, the forefinger, and the middle finger when the user grips the writing stem 12 as well as an interdigital support section 12*b* which contacts the interdigital portion between the thumb and the forefinger. Sections 12*a* and 12*b* are connected together by a connecting member 22*a* of soft elastic material.

The fingertip support section 12*a* has a plurality (e.g., three) of jagged regions with a plurality of ribs, which are located on the rear and each side of the writing stem, respectively, with the clip 16 and the control section 14 facing to the front. The interdigital support section 12*b* has a jagged surface with a number of ribs, which is located at an angle of approximately 180 degrees with respect to the clip 16 and the control section 14 on the circumference of the writing stem 12 (e.g., in a position substantially opposed to them).

With the writing utensil as configured above, the user usually grips the writing stem with the clip and the control section facing upward so that the clip 16 is not an obstacle to the user, and so that the control section 14 is easier to actuate (e.g., depress). The three jagged regions of the fingertip support section 12*a* come into contact with the thumb, the forefinger, and the middle finger, respectively. The jagged surface of the interdigital support section 12*b* comes into contact with the interdigital portion between the thumb and the forefinger. Thus, the writing stem 12 is jointly supported at sections 12*a* and 12*b*.

Moreover, since both the fingertip support section 12*a* and the interdigital support section 1 2*b* are made of a soft elastic material, the user's grip feels softer and more stable when gripping the writing stem, and the writing utensil will not easily slip from the user's grip. Therefore, the user will be less fatigued from continuous writing.

In addition, to feed a predetermined amount of lead, the user can depress the control section 14, for example, with the forefinger only, without moving the user's hand away from the sections 12*a* and 12*b*.

Since the soft section 22 is located in the middle of the writing stem 12 in an axial direction, a wide variety of novel designs can be provided, for example, by using different color combinations for the soft section 22 and the hard section 20.

Second Embodiment

Figure 4:
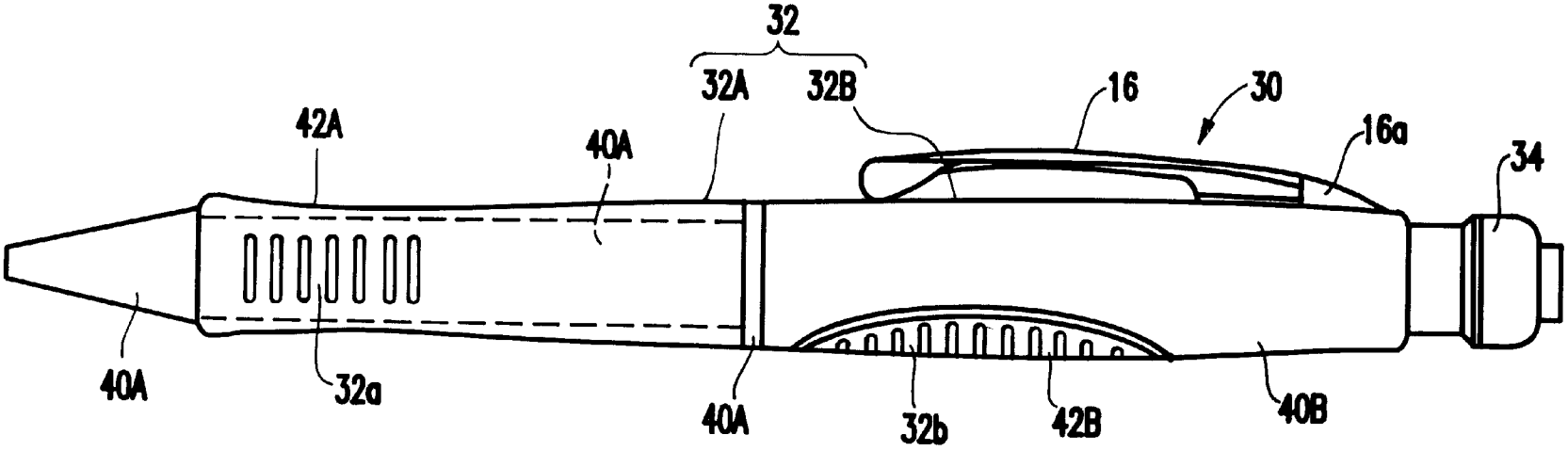
FIG. 4 shows a side view of a second embodiment of the writing utensil according to the present invention.
Figure 5:
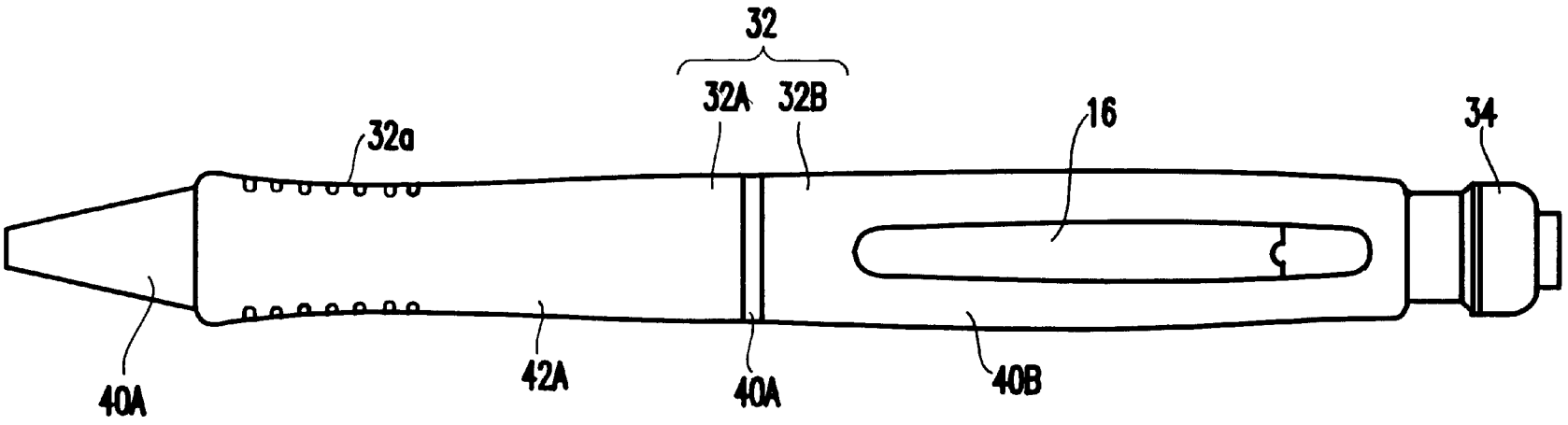
FIG. 5 shows a front view of the second embodiment.

Referring to FIGS. 4 and 5, a second embodiment of the present invention will be described below. In these figures, the same members as in the first embodiment are assigned the same reference numerals and those members will not be described herein below in detail.

As shown in FIGS. 4–5, an exemplary writing utensil (instrument) 30 is a rear end knock-type propelling pencil. In such a rear end knock-type pencil, a control section 34 to feed a predetermined amount of lead is located at the rear end of a writing stem 32, and is connected to a lead feeding mechanism contained within the writing stem 32, so that lead can be fed by depressing the control section 34.

The writing stem 32 includes two members, (e.g., a forebarrel 32A and an afterbarrel 32B) which are screwed onto each other. As in the first embodiment, the whole writing stem 32 includes hard sections 40A and 40B whose surfaces are made of a hard material, and soft sections 42A and 42B whose surfaces are made of a soft elastic material. The forebarrel 32A is formed by fitting a barrel section made of a soft elastic material (e.g., the soft section 42A) into a smaller-diameter annular section located substantially in the middle of the hard section 40A. In the afterbarrel 32B, the soft section 42B and the hard section 40B are integrally molded through dichromatic molding.

The soft section 42A includes a fingertip support section 32*a* which usually comes into contact with the tips of the user's thumb, the forefinger, and the middle finger when the user grips the writing stem 32. The fingertip support section 32*a* has a plurality (e.g., two) of jagged regions with a number of ribs, which are located on each side of the writing stem, respectively, with the clip 16 facing to the front.

The soft section 42B is provided in a position substantially opposed to the clip 16 on the circumference of the writing stem 32 to include an interdigital support section 32*b* which comes into contact with the interdigital portion between the thumb and the forefinger and the interdigital support section 32*b* has a jagged surface with a number of ribs.

With the writing utensil 30 as configured above, as in the first embodiment, the user usually grips the writing stem with the clip 16 facing upward so that the clip 16 is not an obstacle to the user. Accordingly, the two jagged regions of the fingertip support section 32*a* come into contact with the thumb and the forefinger. The jagged surface of the interdigital support section 32*b* will come into contact with the interdigital portion between the thumb and the forefinger. Thus, those sections can jointly support the writing stem 32. Therefore, the second embodiment can achieve the same effect as the first embodiment.

Third Embodiment

Figure 6:
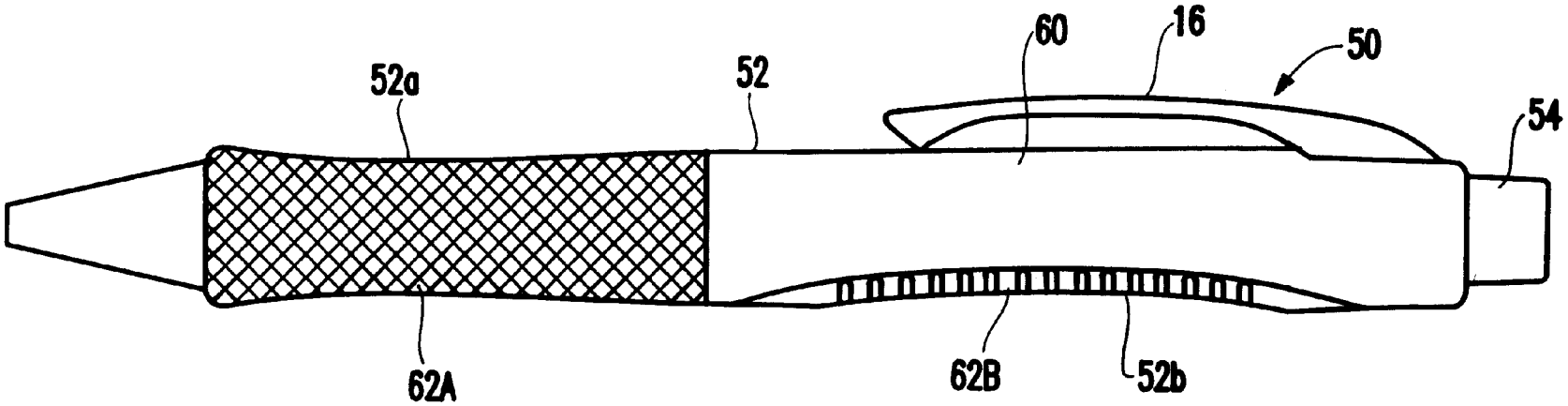
FIG. 6 shows a side view of a third embodiment of the writing utensil according to the present invention.

Referring to FIG. 6, a third embodiment of the present invention will be described below. In FIG. 6, the same members as in the above-mentioned embodiments are assigned the same reference numerals and those members will not be described herein below in detail.

As shown in FIG. 6, an exemplary writing utensil 50 is a rear end knock-type ball point pen. In such a rear end knock-type ball point pen, the tip of a ball point pen refill (e.g., container) which contains ink as exemplary writing media can be propelled outwardly by actuating (e.g., depressing) a control section 54.

The writing stem 52 of the writing utensil 50 includes a hard section 60 whose surface is made of a hard material and soft sections 62A and 62B whose surfaces are made of a soft elastic material.

The soft section 62A includes a barrel section fitted into an annular groove in the hard section 60, and is provided to include a fingertip support section 52*a* which usually comes into contact with the tips of the user's thumb, the forefinger, and the middle finger. In addition, the soft section 62A has a jagged surface (e.g., irregular, non-uniform) with a grid-like pattern.

The soft section 62B is provided in a position substantially opposed to the clip 16 on the circumference of the writing stem 52 to include an interdigital support section 52*b* which comes into contact with the interdigital portion between the thumb and the forefinger, and the interdigital support section 52*b* is recessed in a smooth curve and has a jagged surface with a number of ribs.

The writing utensil 50 can achieve the same effect as the above-mentioned embodiments. Particularly, due to the recessed shape, the interdigital support section 52*b* can come into contact with the interdigital portion of the user more snugly and the user can experience a more stable grip.

Fourth Through Eighth Embodiments

FIGS. 7 through 11 show a perspective view of fourth through eighth embodiments, respectively.

Figure 7:
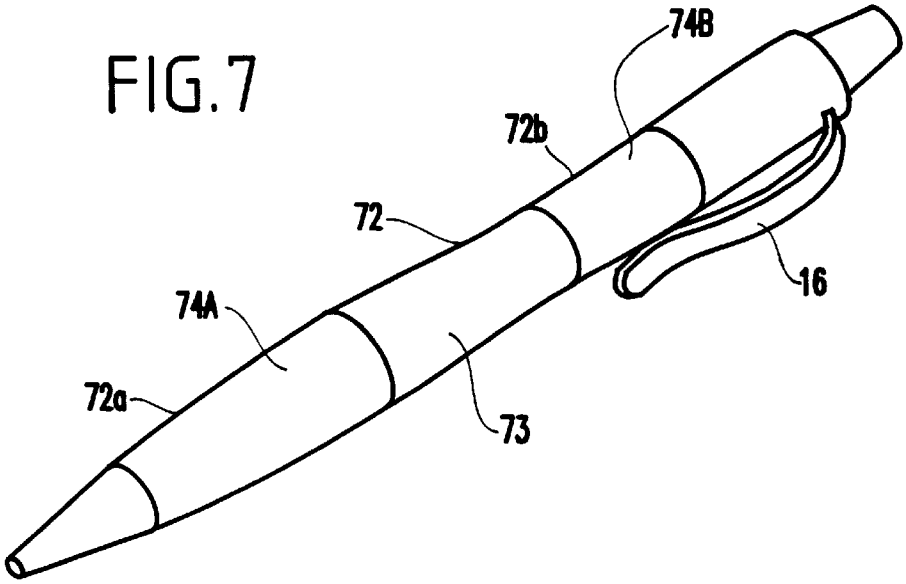
FIG. 7 shows a perspective view of a fourth embodiment of the writing utensil according to the present invention.

In the fourth embodiment as shown in FIG. 7, the surface of a writing stem 72 includes a hard section 73 and soft sections 74A and 74B. The barrel-like soft sections 74A and 74B are fitted into a groove in the hard section 73 to include a fingertip support section 72*a* and an interdigital support section 72*b*, respectively.

Figure 8:
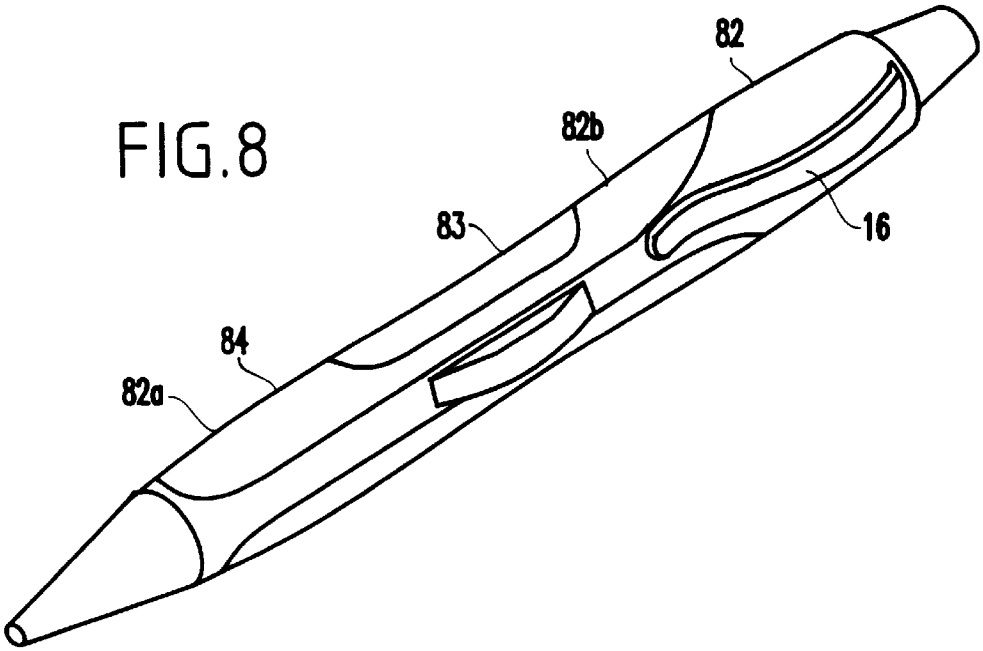
FIG. 8 shows a perspective view of a fifth embodiment of the writing utensil according to the present invention.

In the fifth embodiment as shown in FIG. 8, the surface of a writing stem 82 includes a hard section 83 and a soft section 84. The soft section 84 is provided over a region extending from the forebarrel portion to the middle portion of the writing stem to include a fingertip support section 82*a* and an interdigital support section 82*b*. The connecting region between the fingertip support section 82*a* and the interdigital support section 82*b* is narrower than these sections.

Figure 9:
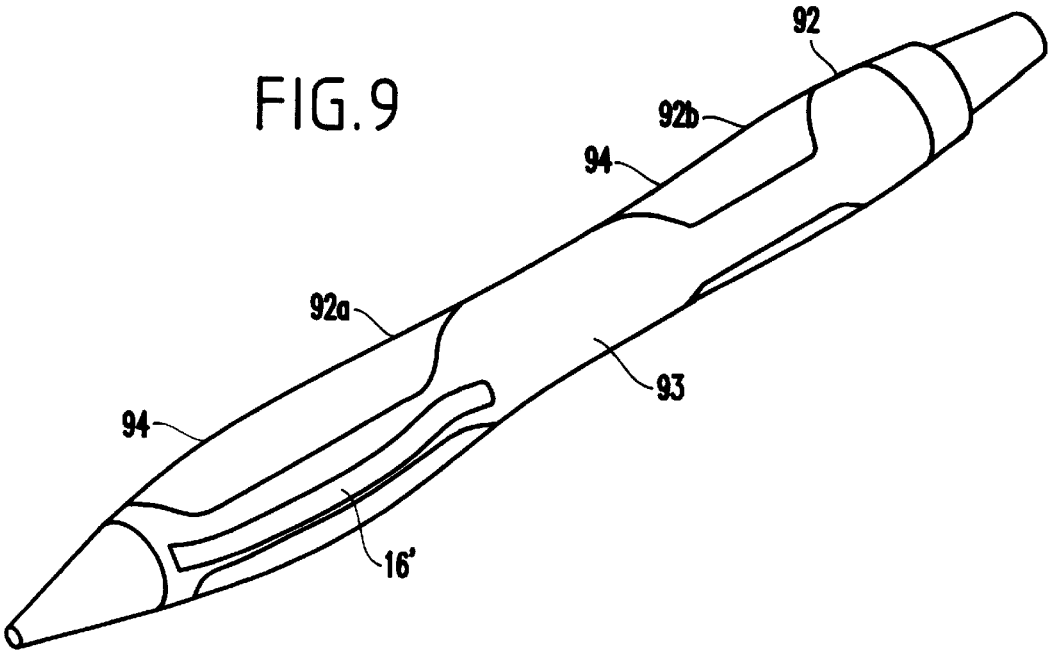
FIG. 9 shows a perspective view of a sixth embodiment of the writing utensil according to the present invention.

In the sixth embodiment as shown in FIG. 9, a clip 16' is located in the forebarrel portion of a writing stem 92. However, as in the above-mentioned embodiments, the surface of the writing stem 92 includes a hard section 93 and a soft section 94. The soft section 94 covers a region extending from the forebarrel portion to the middle portion of the writing stem to include a fingertip support section 92*a* and an interdigital support section 92*b*.

The clip 16' is formed to be substantially flush with the outer surface of the writing stem 92 and extends in a longitudinal direction parallel to the writing stem 92. When the front end of the clip 16' is pressed toward the inside of the writing stem 92, the rear end of the clip 16' is propelled outwardly of the outer surface of the writing stem 92 so that the clip 16' can clip onto a user's pocket or another location.

Figure 10:
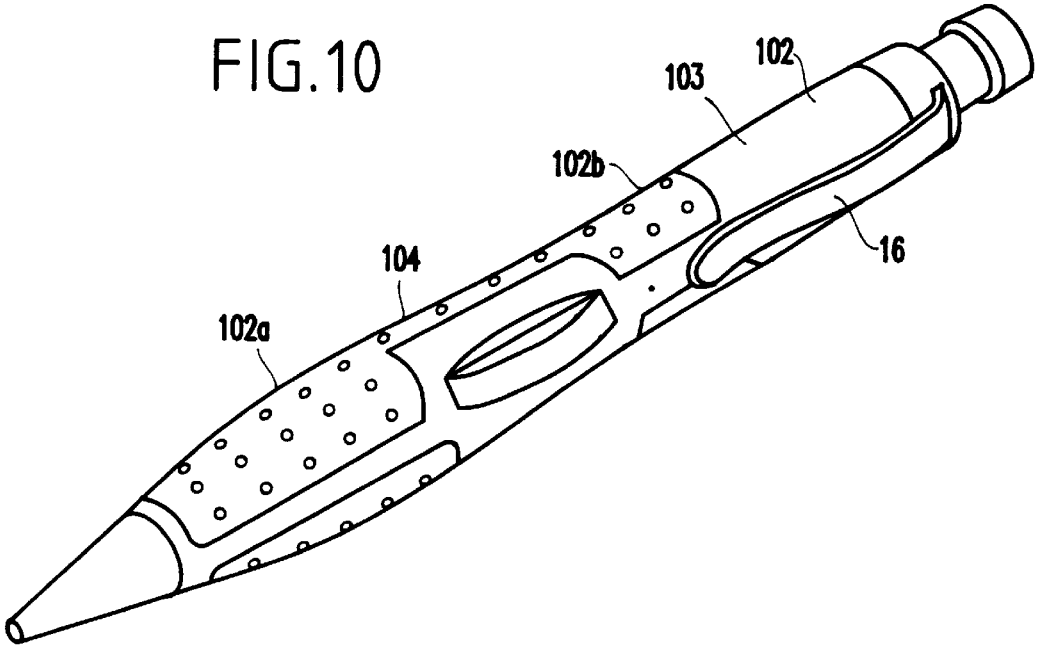
FIG. 10 shows a perspective view of a seventh embodiment of the writing utensil according to the present invention.

The seventh embodiment as shown in FIG. 10 is an exemplary side knock-type writing utensil and the surface of a writing stem 102 includes a hard section 103 and a soft section 104.

The soft section 104 covers a region extending from the forebarrel portion to the middle portion of the writing stem to include a fingertip support section 102*a* and an interdigital support section 102*b*. In addition, the soft section 104 has an uneven surface with a large number of concavities.

Figure 11:
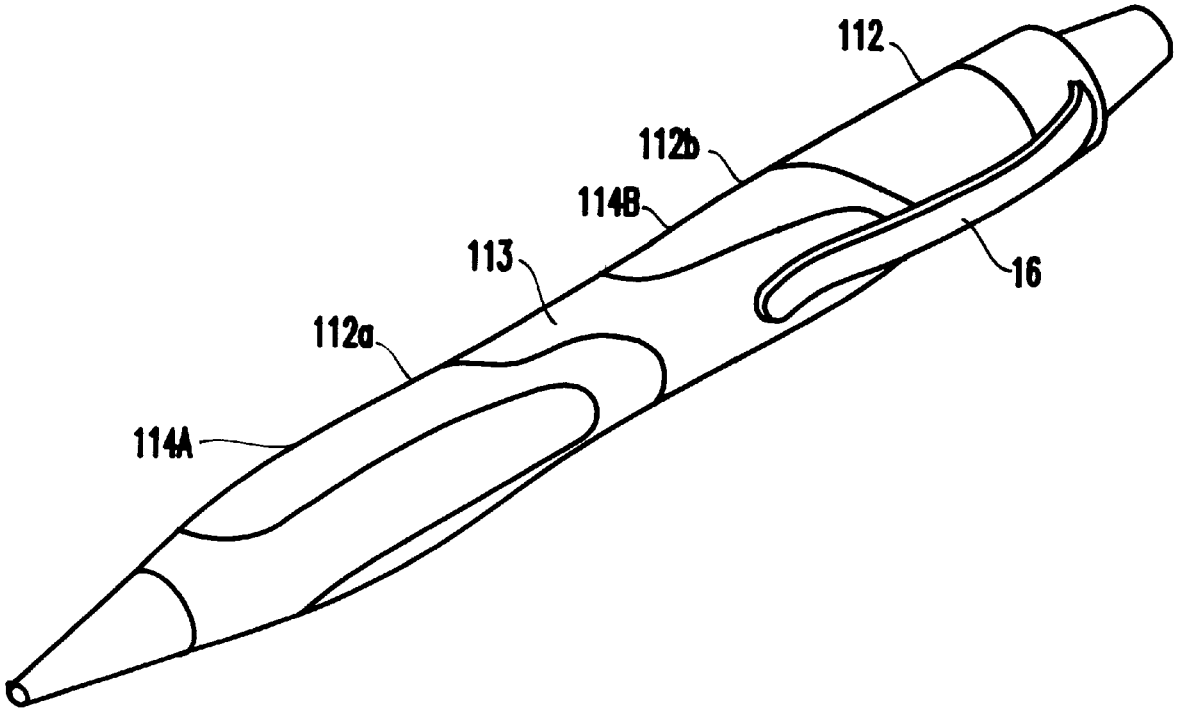
FIG. 11 shows a perspective view of an eighth embodiment of the writing utensil according to the present invention.

In the eighth embodiment as shown in FIG. 11, the surface of a writing stem 112 includes a hard section 113 and soft sections 114A and 114B. The soft sections 114A and 114B include a fingertip support section 112*a* and an interdigital support section 112*b*, respectively. These sections are not formed into a barrel-like shape, but instead are formed into a specific streamlined shape when being viewed from the side.

It should be appreciated that, as shown in FIGS. 7 through 11, numerous variations may be made to the present invention and any of them can make the user feel more stable when gripping the writing stem as well as demonstrate the possibility of various novel designs.

While the invention has been described in terms of several preferred embodiments, those skilled in the art will recognize that the invention can be practiced with modification within the spirit and scope of the appended claims.

Having thus described my invention, what I claim as new and desire to secure by letters patent is as follows:

1. A writing utensil, comprising:

a writing stem having a first surface section of a soft elastic material, and a second surface section of a relatively hard material, wherein said first surface section includes an interdigital support section comprising soft elastic material for supporting the interdigital portion between a thumb and a forefinger of a user gripping said writing stem, said first surface being integrally molded through dichromatic molding with said second surface section.

2. The writing utensil according to claim 1, wherein said first surface section further comprises a fingertip support section made of soft elastic material which comes into contact with a user's fingertip gripping said writing stem.

3. The writing utensil according to claim 2, wherein said first surface section further comprises a connecting member, said interdigital support section and said fingertip support section being connected together by said connecting member.

4. The writing utensil according to claim 1, wherein said interdigital support section has a jagged surface.

5. The writing utensil according to claim 1, wherein said interdigital support section has a recessed smooth surface.

6. The writing utensil according to claim 1, further comprising:

a clip extending in a longitudinal direction parallel to said writing stem, wherein said interdigital support section is located substantially in a position opposed to said clip on a circumference of said writing stem.

7. The writing utensil according to claim 1, further comprising:

a control section for feeding writing media located substantially in the middle of said writing stem in an axial direction, wherein said interdigital support section is located substantially in a position opposed to said control section on the circumference of said writing stem.

8. The writing utensil according to claim 1, wherein said second surface section comprises at least one of ABS resin and acrylic resin.

9. The writing utensil according to claim 1, wherein said first surface section comprises at least one of silicon rubber, olefin elastomer, vinyl chloride elastomer, styrene elastomer, and a thermoplastic elastomer.

10. A writing utensil, comprising:

a writing tip; and a writing stem including a forebarrel adjacent to said writing tip and an afterbarrel at an end opposite said writing tip said writing stem having an interdigital support section for supporting the interdigital portion between a user's thumb and forefinger gripping said writing stem, wherein said forebarrel has a first surface section adjacent said writing tip formed of a soft elastic material, and a second surface section adjacent said writing tip formed of a hard material, wherein said afterbarrel at an end opposite said writing tip has a first surface section formed of a soft elastic material, said first surface section of said afterbarrel including the interdigital support section, and a second surface section formed of a hard material, said first surface section of said afterbarrel being integrally molded through dichromatic molding with said second surface section of said afterbarrel.

11. The writing utensil according to claim 10, wherein said writing stem further includes a fingertip support section made of a soft elastic material which comes into contact with a user's fingertip gripping said writing stem.

12. The writing utensil according to claim 10, wherein said writing stem further comprises a fingertip support section made of a soft elastic material which comes into contact with a user's fingertip gripping said writing stem, said fingertip support section having a plurality of ribs.

13. The writing utensil according to claim 10, wherein said interdigital support section has a jagged surface with a plurality of ribs.

14. The writing utensil according to claim 10, further comprising a connecting region provided between said interdigital support section and a fingertip support section of said writing stem, and having an outer circumference smaller than those of said interdigital support section and said fingertip support section.

15. A writing instrument, comprising:

a writing stem having a first surface section of a soft elastic material, and a second surface section of a relatively hard material; and wherein said first surface section comprises an interdigital support section comprising a soft elastic material for supporting the interdigital portion between a user's thumb and forefinger gripping said writing stem, said first surface section being integrally molded through dichromatic molding with said second surface section.

16. The writing instrument according to claim 15, wherein said first surface section comprises a fingertip support section of a soft elastic material for supporting the thumb, the forefinger, and a middle finger of the user, and having a jagged surface with a grid-like pattern.

17. The writing instrument according to claim 15, wherein said interdigital support section is recessed in a smooth curve and has a jagged surface with a plurality of ribs.

18. The writing instrument according to claim 15, wherein said interdigital support section comprises an uneven surface with a plurality of concavities.

19. The writing instrument according to claim 15, said first surface section comprising a connecting region provided between said interdigital support section and a fingertip support section, and having an outer circumference smaller than those of said interdigital support section and said fingertip support section.

20. A writing utensil, comprising:

a writing stem having a first surface section of a soft elastic material, and a second surface section of a relatively hard material; and a clip extending in a longitudinal direction parallel to said writing stem, wherein said first surface section comprises an interdigital support section comprising soft elastic material for supporting the interdigital portion between a thumb and a forefinger of a user gripping said writing stem, and said interdigital support section is located substantially in a position opposed to said clip on a circumference of said writing stem.

21. The writing utensil according to claim 20, wherein said first surface section further comprises a fingertip support section made of soft elastic material which comes into contact with a user's fingertip gripping said writing stem.

22. The writing utensil according to claim 21, wherein said first surface section further comprises a connecting member, said interdigital support section and said fingertip support section being connected together by said connecting member.

23. The writing utensil according to claim 20, wherein said interdigital support section has a jagged surface.

24. The writing utensil according to claim 20, wherein said interdigital support section has a recessed smooth surface.

25. The writing utensil according to claim 20, further comprising a control section for feeding writing media located substantially in the middle of said writing stem in an axial direction, wherein said interdigital support section is located substantially in a position opposed to said control section on a circumference of said writing stem.

26. The writing utensil according to claim 20, wherein said second surface section comprises at least one of ABS resin and acrylic resin.

27. The writing utensil according to claim 20, wherein said first surface section comprises at least one of silicone rubber, olefin elastomer, vinyl chloride elastomer, styrene elastomer, and a thermoplastic elastomer.

28. A writing utensil, comprising:

a writing tip;

a writing stem including a forebarrel adjacent to said writing tip and an afterbarrel at an end opposite said writing tip; and a clip extending in a longitudinal direction parallel to said writing stem, said writing stem having an interdigital support section of a soft elastic material for supporting the interdigital portion between a user's thumb and forefinger gripping said writing stem, wherein said forebarrel comprises a first surface section adjacent said writing tip formed of a soft elastic material, and a second surface section adjacent said writing tip formed of a hard material, wherein said afterbarrel at an end opposite said writing tip has a first surface section formed of a soft elastic material, said first surface section of said afterbarrel including the interdigital support section, and a second surface section formed of a hard material, wherein said interdigital support section is located substantially in a position opposed to said clip on a circumference of said writing stem.

29. The writing utensil according to claim 28, wherein said writing stem further comprises a fingertip support section made of a soft elastic material which comes into contact with a user's fingertip gripping said writing stem.

30. The writing utensil according to claim 28, wherein said first surface section of said afterbarrel is integrally molded through dichromatic molding with said second surface section.

31. The writing utensil according to claim 28, wherein said writing stem further comprises a fingertip support section made of a soft elastic material which comes into contact with a user's fingertip gripping said writing stem, said fingertip support section having a plurality of ribs.

32. The writing utensil according to claim 28, wherein said interdigital support section comprises a jagged surface with a plurality of ribs.

33. The writing utensil according to claim 28, further comprising a connecting region provided between said interdigital support section and a fingertip support section of said writing stem, and having an outer circumference smaller than those of said interdigital support section and said fingertip support section.

34. A writing instrument, comprising:

a writing stem having a first surface section of a soft elastic material, and a second surface section of a relatively hard material; and a clip extending in a longitudinal direction parallel to said writing stem, wherein said first surface section comprises an interdigital support section comprising a soft elastic material for supporting the interdigital portion between a user's thumb and forefinger gripping said writing stem, and said interdigital support section is located substantially in a position opposed to said clip on a circumference of said writing stem.

35. The writing instrument according to claim 34, wherein said first surface section comprises a fingertip support section of a soft elastic material for supporting the thumb, the forefinger, and a middle finger of the user, and having a jagged surface with a grid-like pattern.

36. The writing instrument according to claim 34, wherein said interdigital support section is recessed in a smooth curve and has a jagged surface with a plurality of ribs.

37. The writing instrument according to claim 34, wherein said interdigital support section comprises an uneven surface with a plurality of concavities.

38. The writing instrument according to claim 34, wherein said first surface section comprises a connecting region provided between said interdigital support section and a fingertip support section, and includes an outer circumference smaller than those of said interdigital support section and said fingertip support section.

39. A writing utensil, comprising:

a writing stem having a first surface section of a soft elastic material, and a second surface section of a relatively hard material; and a control section for feeding writing media located substantially in the middle of said writing stem in an axial direction, wherein said first surface section includes an interdigital support section comprising soft elastic material for supporting the interdigital portion between a thumb and a forefinger of a user gripping said writing stem, and said interdigital support section is located substantially in a position opposed to said control section on a circumference of said writing stem.

40. The writing utensil according to claim 39, wherein said first surface section further comprises a fingertip support section made of soft elastic material which comes into contact with a user's fingertip gripping said writing stem.

41. The writing utensil according to claim 40, wherein said first surface section further comprises a connecting member, said interdigital support section and said fingertip support section being connected together by said connecting member.

42. The writing utensil according to claim 39, wherein said interdigital support section has a jagged surface.

43. The writing utensil according to claim 39, wherein said interdigital support section has a recessed smooth surface.

44. The writing utensil according to claim 38, wherein said second surface section comprises at least one of ABS resin and acrylic resin.

45. The writing utensil according to claim 39, wherein said first surface section comprises at least one of silicone rubber, olefin elastomer, vinyl chloride elastomer, styrene elastomer, and a thermoplastic elastomer.

46. A writing utensil, comprising:

a writing tip;

a writing stem including a forebarrel adjacent to said writing tip and an afterbarrel at an end opposite said writing tip; and a control section located substantially in the middle of said writing stem in an axial direction, said writing stem having an interdigital support section of a soft elastic material for supporting the interdigital portion between a user's thumb and forefinger gripping said writing stem, wherein said forebarrel comprises a first surface section adjacent said writing tip formed of a soft elastic material, and a second surface section adjacent said writing tip formed of a hard material, wherein said afterbarrel at an end opposite said writing tip has a first surface section formed of a soft elastic material, said first surface section of said afterbarrel including the interdigital support section, and a second surface section formed of a hard material, and wherein said interdigital support section is located substantially in a position opposed to said control section on a circumference of said writing stem.

47. The writing utensil according to claim 46, wherein said writing stem further comprises a fingertip support section made of a soft elastic material which comes into contact with a user's fingertip gripping said writing stem.

48. The writing utensil according to claim 46, wherein said first surface section of said afterbarrel is integrally molded through dichromatic molding with said second surface section of said afterbarrel.

49. The writing utensil according to claim 46, wherein said writing stem further comprises a fingertip support section made of a soft elastic material which comes into contact with a user's fingertip gripping said writing stem, said fingertip support section having a plurality of ribs.

50. The writing utensil according to claim 46, wherein said interdigital support section has a jagged surface with a plurality of ribs.

51. The writing utensil according to claim 46, further comprising a connecting region provided between said interdigital support section and a fingertip support section of said writing stem, and having an outer circumference smaller than those of said interdigital support section and said fingertip support section.

52. A writing instrument, comprising:

a writing stem having a first surface section of a soft elastic material, and a second surface section of a relatively hard material; and a control section for feeding writing media located substantially in the middle of said writing stem in an axial direction, wherein said first surface section comprises an interdigital support section comprising a soft elastic material for supporting the interdigital portion between a user's thumb and forefinger gripping said writing stem, and said interdigital support section is located substantially in a position opposed to said control section on a circumference of said writing stem.

53. The writing instrument according to claim 52, wherein said first surface section comprises a fingertip support section of a soft elastic material for supporting the thumb, the forefinger, and a middle finger of the user, and having a jagged surface with a grid-like pattern.

54. The writing instrument according to claim 52, wherein said interdigital support section is recessed in a smooth curve and has a jagged surface with a plurality of ribs.

55. The writing instrument according to claim 52, wherein said interdigital support section comprises an uneven surface with a plurality of concavities.

56. The writing instrument according to claim 52, wherein said first surface section comprises a connecting region provided between said interdigital support section and a fingertip support section, and having an outer circumference smaller than those of said interdigital support section and said fingertip support section.

57. A writing instrument, comprising:

a writing stem having a first surface section of a soft elastic material, and a second surface section of a relatively hard material, wherein said first surface section comprises an interdigital support section comprising a soft elastic material for supporting the interdigital portion between a user's thumb and forefinger gripping said writing stem, and a connecting region provided between said interdigital support section and a fingertip support section, and has an outer circumference smaller than those of said interdigital support section and said fingertip support section.

58. The writing instrument according to claim 57, wherein the fingertip support section comprises a soft elastic material for supporting the thumb, the forefinger, and a middle finger of the user, and having a jagged surface with a grid-like pattern.

59. The writing instrument according to claim 57, wherein said interdigital support section is recessed in a smooth curve and has a jagged surface with a plurality of ribs.

60. The writing instrument according to claim 57, wherein said interdigital support section comprises an uneven surface with a plurality of concavities.

* * * * *